US010928102B2

(12) United States Patent
Liengaard et al.

(10) Patent No.: US 10,928,102 B2
(45) Date of Patent: Feb. 23, 2021

(54) REFRIGERATION DEVICE COMPRISING MULTIPLE STORAGE CHAMBERS

(71) Applicant: BSH HAUSGERAETE GMBH, Munich (DE)

(72) Inventors: Niels Liengaard, Ulm (DE); Vitali Ulrich, Illertissen (DE); Alexander Foeldi, Giengen/Brenz (DE)

(73) Assignee: BSH Hausgeraete GmbH, Munich (DE)

( * ) Notice: Subject to any disclaimer, the term of this patent is extended or adjusted under 35 U.S.C. 154(b) by 75 days.

(21) Appl. No.: 15/751,488

(22) PCT Filed: Aug. 16, 2016

(86) PCT No.: PCT/EP2016/069371
§ 371 (c)(1),
(2) Date: Feb. 9, 2018

(87) PCT Pub. No.: WO2017/036777
PCT Pub. Date: Mar. 9, 2017

(65) Prior Publication Data

US 2018/0231277 A1 Aug. 16, 2018

(30) Foreign Application Priority Data

Sep. 3, 2015 (DE) ..... 10 2015 216 933.2

(51) Int. Cl.
*F25B 41/04* (2006.01)
*F25B 41/06* (2006.01)
(Continued)

(52) U.S. Cl.
CPC ..... *F25B 5/00* (2013.01); *F25B 5/02* (2013.01); *F25B 5/04* (2013.01); *F25B 41/043* (2013.01);
(Continued)

(58) Field of Classification Search
CPC ..... F25B 2341/0661; F25B 2341/0662; F25B 41/043; F25B 41/062; F25B 41/067;
(Continued)

(56) References Cited

U.S. PATENT DOCUMENTS 4,184,341 A * 1/1980 Friedman ..... F25B 5/02 236/1 EA
7,937,962 B2 5/2011 Dudley et al.
(Continued)

FOREIGN PATENT DOCUMENTS

CN 101360959 A 2/2009
CN 101487640 A 7/2009
(Continued)

OTHER PUBLICATIONS

Klein et al., Refrigeration System Performance using Liquid-Suction Heat Exchangers, International Journal of Refrigeration, vol. 23 , Part 8, pp. 588-596, 2000 (Year: 2000).*
(Continued)

*Primary Examiner* — Edward F Landrum
*Assistant Examiner* — Chang H Park
(74) *Attorney, Agent, or Firm* — Laurence A. Greenberg; Werner H. Stemer; Ralph E. Locher

(57) ABSTRACT

A refrigerant circuit of a refrigeration device, such as a household refrigeration device, has the following connected in series between a pressure connection and a suction connection of a compressor: a condenser, a first throttle point, a first evaporator for cooling a first storage chamber, a second throttle point. At least one of the first and second throttle points are adjusted to control the pressure in the first evaporator. The refrigerant circuit has a first branch with the first throttle point, the first evaporator and the second throttle point, and at least one second branch, parallel to the first branch, in which a third throttle point, a second evaporator
(Continued)

arranged in thermal contact with a second storage chamber and a fourth throttle point are connected in series. At least one of the third and fourth throttle points can be adjusted to control the pressure in the second evaporator.

9 Claims, 1 Drawing Sheet

(51) Int. Cl.

| | |
|---|---|
| ***F25B 5/00*** | (2006.01) |
| ***F25B 5/02*** | (2006.01) |
| ***F25B 5/04*** | (2006.01) |
| ***F25D 11/02*** | (2006.01) |

(52) U.S. Cl.
CPC ..... *F25B 41/062* (2013.01); *F25B 41/067* (2013.01); *F25D 11/022* (2013.01); *F25B 2341/0661* (2013.01); *F25B 2341/0662* (2013.01)

(58) Field of Classification Search
CPC ..... F25B 5/00; F25B 5/02; F25B 5/04; F25B 2400/04; F25B 2400/0409; F25D 11/022
See application file for complete search history.

(56) References Cited

U.S. PATENT DOCUMENTS

| | | | | |
|---|---|---|---|---|
| 8,375,734 | B2 * | 2/2013 | Hall | F25B 41/062 62/225 |
| 2014/0223925 | A1 | 8/2014 | Kawakami et al. | |
| 2016/0265833 | A1 * | 9/2016 | Yoon | F25D 11/022 |
| 2016/0273822 | A1 * | 9/2016 | Liengaard | F25B 5/04 |

FOREIGN PATENT DOCUMENTS

| | | | | |
|---|---|---|---|---|
| CN | 103026148 | A | 4/2013 | |
| CN | 103411339 | A | 11/2013 | |
| CN | 103781644 | A | 5/2014 | |
| CN | 204128235 | U | 1/2015 | |
| CN | 104406317 | A | 3/2015 | |
| DE | 102013223737 | A1 * | 5/2015 | F25B 5/04 |
| DE | 102013223737 | A1 | 5/2015 | |
| EP | 1684027 | A2 | 7/2006 | |
| EP | 2796810 | A1 | 10/2014 | |
| GB | 2017890 | A | 10/1979 | |
| JP | 2008101885 | A | 5/2008 | |
| WO | 2007084138 | A1 | 7/2007 | |

OTHER PUBLICATIONS

Kazmer, Plastics Manufacturing Systems Engineering—A Systems Approach, Hanser Publishers, 2009, pp. 112-116, 2009 (Year: 2009).*

Kostora, Variable Speed's Impact on HVAC, theNEWS, 2017 (Year: 2017).*

* cited by examiner

REFRIGERATION DEVICE COMPRISING MULTIPLE STORAGE CHAMBERS

BACKGROUND OF THE INVENTION

Field of the Invention

The present invention relates to a refrigeration appliance, in particular a domestic refrigeration appliance, with at least two storage chambers which can be operated at different temperatures.

In most refrigeration appliances of this kind, the operating temperatures of the storage compartments are roughly defined due to the construction type of the refrigeration appliance and in each case can only be set in narrow ranges which do not overlap, so that the potential use of a compartment, for example as a refrigeration or freezer compartment, cannot be changed by the user of the refrigeration appliance.

A refrigeration appliance is known from DE 10 2013 223 737A1, in which the evaporators of two storage chambers are linked in series via a choke point with adjustable flow conductance value. The choke point makes it possible for the temperature of the two storage chambers to be varied to a relatively great extent. The operating temperature of one compartment, however, also limits the setting range of the other. Since the pressure in the downstream evaporator can never be higher than that of the upstream evaporator, at a predefined temperature of the compartment cooled by the upstream evaporator the temperature of the other can only be set lower, or when the temperature of the compartment cooled by the downstream evaporator is predefined, that of the other can only be set higher. This makes it difficult to adapt the refrigeration appliance to the changing needs of its user.

SUMMARY OF THE INVENTION

The object of the present invention is to specify a refrigeration appliance with a plurality of storage chambers, in which the operating temperature set for one of the storage chambers does not restrict the temperature range in which the operating temperature of another storage chamber can be selected.

The object is achieved in that, with a refrigeration appliance, in particular a domestic refrigeration appliance, with a plurality of storage chambers and a refrigerant circuit, on which the following are connected in series one after the other between a pressure port and a suction port of a compressor:

A condenser, a first choke point, a first evaporator for cooling a first storage chamber and a second choke point, wherein at least one of the first and second choke points can be set in order to control the pressure in the first evaporator, the refrigerant circuit comprises a first branch, which contains the first choke point, the first evaporator and the second choke point, and at least one second branch in parallel with said first branch, in which a third choke point, a second evaporator arranged in thermal contact with a second storage chamber and a fourth choke point are linked in series, wherein at least one of the third and fourth choke points also can be set in order to control the pressure in the second evaporator.

On the basis of the parallel connection of the branches, it is both possible with the aid of the settable choke points to set a higher pressure in the first evaporator than in the second and thus set a higher operating temperature in the first storage chamber than in the second, and also vice versa.

Of the first and second and/or of the third and fourth choke points, both can be set in each case, so that in particular the pressure in the evaporators lying in between can be varied, without this having an impact on the overall pressure drop or the refrigerant throughput of the branch in question.

Of the first and third choke points, at least one may comprise a capillary tube. Such a choke point can, nonetheless, be settable if the capillary tube which cannot itself be set is linked to an electronic expansion valve in series.

For reasons of simplicity, it is preferred that of the first and third choke points at least one, preferably precisely one, has a fixed flow conductance value and in particular is exclusively formed by a capillary tube. In order to set the pressure in the first or second evaporator arbitrarily, it is sufficient if in each case only one choke point can be set in each branch.

Changes to the refrigerant throughput in a branch, which may result from a shifting of the flow conductance value in the second or fourth choke point not only being able to be equalized by an opposing shift in the first or third choke point embodied as a capillary tube, can be avoided by using a variable-speed compressor.

If the compressor is a variable-speed compressor, the rotational speed thereof furthermore can be adapted such that the compressor operates essentially without interruptions. Losses in efficiency, which are associated with the interim warming up of parts of the refrigeration appliance while the compressor is at a standstill and the recooling of said parts following the start of the compressor, can be avoided in this way.

Between the downstream evaporator of any branch and a junction, at which the branches convene, in each case there should be provision for a choke point in order to be able to set different pressures in the evaporators of the two branches lying upstream from said choke points.

A third evaporator for cooling a third storage chamber can be connected between the second choke point and the suction port, in order to also use the refrigeration which is generated as the refrigerant depressurizes upon passing through the second choke point.

The junction may lie downstream or upstream from said third evaporator; in the first case the temperature setting range of the second evaporator is at its highest, since its pressure can become lower than in the third evaporator; in the latter case the construction of the refrigeration appliance is simpler and a more energy-efficient operation is possible and in the third evaporator it is still possible to use that part of the cooling output which is bound in the refrigerant which flows out from the second evaporator without having expanded completely.

A suction pipe heat exchanger can be arranged between the pressure port of the compressor and at least the first evaporator, in order to precool compressed refrigerant on the way to the evaporator in thermal contact with the refrigerant vapor extracted from the evaporators.

If the suction pipe heat exchanger is arranged in the first branch, although it only enables an energy-efficient refrigeration at this location, conversely it is also possible for compressed refrigerant in the second branch to reach the second evaporator without having to be cooled, in the suction pipe heat exchanger previously. The refrigerant can therefore reach the second evaporator at a higher temperature than the ambient temperature and, instead of cooling, can release its heat to the second storage chamber.

If the pressure in the second evaporator is set so high that the saturation temperature, i.e. the temperature at which the refrigerant condenses or evaporates at the set pressure, lies above the compartment temperature but below the temperature of the inflowing refrigerant, then the second evaporator can even be operated as a condenser and in this manner can also release a considerable heating output with a low refrigerant throughput.

BRIEF DESCRIPTION OF THE SEVERAL VIEWS OF THE DRAWING

Further features and advantages of the invention will emerge from the description of exemplary embodiments provided below, with reference to the attached figures, in which.

DESCRIPTION OF THE INVENTION

Figure 1:
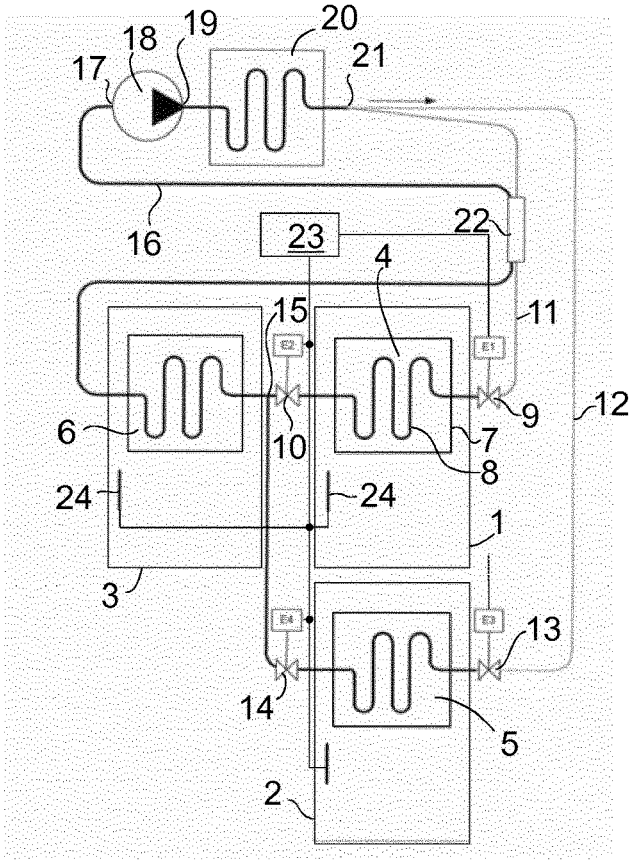
FIG. 1 shows a block diagram of a refrigeration appliance in accordance with a first embodiment of the invention.

The refrigeration appliance in FIG. 1 comprises three storage chamber 1, 2, 3 which are arranged in a carcass above and/or adjacent to one another and are thermally insulated both from one another and also from the surroundings. Each storage chamber 1, 2, 3 is assigned an evaporator 4, 5 and 6, respectively. The evaporators 4, 5, 6 have a construction type which is freely known in principle. This may involve, as indicated in the Figure, sheet evaporators, on the sheets 7 of which a refrigerant line 8 runs in a meandering manner in each case and which can be attached in each case within their storage chamber 1, 2, 3 or between an interior container of the storage chamber and a thermal insulation layer surrounding the interior container. This may also, however, involve wire-on-tube or fin evaporator, optionally in combination with a fan driving the air circulation over the evaporator.

The evaporator 4, together with a choke point 9 connected upstream with an adjustable flow conductance value, a choke point 10 connected downstream with an adjustable flow conductance value and a pipeline on which the components specified are arranged in a row, form a first branch 11 of a refrigerant circuit. A second branch 12 in parallel with the first branch 11 comprises the evaporator 5 together with a settable choke point 13 connected upstream and a settable choke point 14 connected downstream. The two branches 11, 12 come together at a junction 15, to which the evaporator 6 connects downstream in the circulation direction of the refrigerant.

The evaporator 6 is linked to a suction port 17 of a compressor 18 via a suction line 16. The refrigerant circuit runs from a pressure port 19 of the compressor 18 via a condenser 20 to a branching 21, from which the two branches 11, 12 diverge.

A part of the branch 11 runs between the branching 21 and the choke point 9 in close contact with the surface of the suction line 16 or even in the interior thereof, in order to form a suction pipe heat exchanger 22, in which the compressed refrigerant, once it has been cooled down in the condenser 20 to just above the ambient temperature, releases further heat to refrigerant vapor in the suction pipe 16 in order to preheat it to the extent that condensation of ambient moisture on parts of the suction pipe 16 which extend outside the thermal insulation layer is avoided.

The pressure which is set in the evaporators 4, 5 and 6 during operation depends on the rotational speed of the compressor 18 as well as on the flow conductance values of the choke points 9, 10, 13, 14 which are set by an electronic control unit 23 on the basis of the measured values from temperature sensors 24 arranged in the storage chambers 1, 2, 3 and operating temperatures selected by the user for the storage chambers 1, 2, 3.

The lowest pressure always prevails in evaporator 6. Accordingly, the lowest operating temperature is achieved in storage chamber 3, which predestines the storage chamber 3 for use as a freezer compartment.

The pressures in the evaporators 4 and 5 can be set with the aid of the choke points 9, 10 or 13, 14, respectively, to largely any desired values between the output pressure of the compressor 18 and the pressure of the evaporator 6. By changing the flow conductance values of the choke points 9, 10 in opposite directions in each case, the pressure in the evaporator 4 may be varied without this having an impact on the quantity of refrigerant which reaches into the evaporator 6 per time unit, and consequently without influencing the saturation temperature there. Accordingly, the pressure in the evaporator 5 may also be varied via the choke points 13, 14, without this having an effect on the evaporator 6.

The choke points 9, 10, 13, 14 may be embodied in their entirety as electronic expansion valves—preferably having an identical construction between them—the flow conductance value thereof being adjustable to a large extent, preferably between a completely closed state and a wide-open state, in which the pressure drop at the choke point is negligible. If, for example, the choke point 10 is wide open and the pressure difference between the evaporators 4, 6 is therefore negligible, then the storage chamber 1 also operates as a freezer compartment. By contrast, if the choke point is wide open, then there is no depressurization of the refrigerant between the condenser 20 and evaporator 4 and no evaporation in the evaporator 4, and the temperature at which the refrigerant reaches into the evaporator 4 essentially corresponds to that which it has assumed in the suction pipe heat exchanger 22. The range of temperatures to which the evaporator 4 can be set thus extends between the temperature reached in the suction pipe heat exchanger 22, which lies slightly below the condensing temperature, but may even be somewhat higher than the ambient temperature, and the temperature of the evaporator 6.

A pressure drop in the choke point 9 does not have any cooling effect on the storage chamber 1, as long as it is not sufficient to lower the boiling temperature of the refrigerant in the evaporator 4 below the temperature of the storage chamber 1. It is therefore possible to realize the choke point 9 as a series connection comprising an expansion valve and a capillary tube, wherein the capillary tube is designed to generate a pressure drop, by way of which the pressure in the evaporators 4 is lowered to such an extent that the boiling temperature of the refrigerant therein corresponds to the ambient temperature. This series connection enables a more precise controlling of the pressure in the evaporator 4 than with an expansion valve alone. Here, the capillary tube expediently comprises that part of the branch 11 which runs through the suction pipe heat exchanger 22.

The pressure in the evaporator 5 can be set independently of that in the evaporator 4 and can assume both lower and also higher values. If, for example, the storage chamber 3 is operated as a freezer compartment at a temperature of typically −17° C. and the storage chamber 1 as a normal refrigerator compartment at a temperature of +4° C. for example, the saturation temperature in the evaporator 6 can be set to any desired values between −17° C. and condensation temperature prevailing in the condenser 20. Since the evaporator 5 is linked to the condenser 20 while bypassing the suction pipe heat exchanger 22, when reaching the choke point 13 the refrigerant generally has a temperature which is higher than the ambient temperature, so that when the choke point 13 is wide open and the pressure drop at that point is negligible, the storage chamber 3 can then be heated by the refrigerant instead of cooled. If the saturation temperature in the evaporator 5 is lower than that of the inflowing refrigerant, then the condensing of the refrigerant can even be continued in the evaporator 5 and the storage chamber 2 can be heated by released condensation heat. Thus, a temperature of +18° C. in the storage chamber 3 appropriate for the temperature-controlled storage of red wine can be realized, for example, even if the ambient temperature is lower. This makes the storage chamber 2 able to be used in an extremely versatile manner, and its operating temperature can be changed as requirements vary, without this impacting the temperatures of the storage chambers 1, 2 and without the temperature of the storage chamber 1 restricting the range of temperatures which can be set for the chamber 2. This single restriction consists in that the temperature of the evaporator 5 cannot be lower than that of the evaporator 6 connected downstream, yet this does not restrict the potential uses of the storage chamber 2 in any way, as long as the chamber 3 is operated as a freezer compartment and the temperature of its evaporator 6 is in any case the lowest temperature which can be practically realized in the refrigerant circuit.

Figure 2:
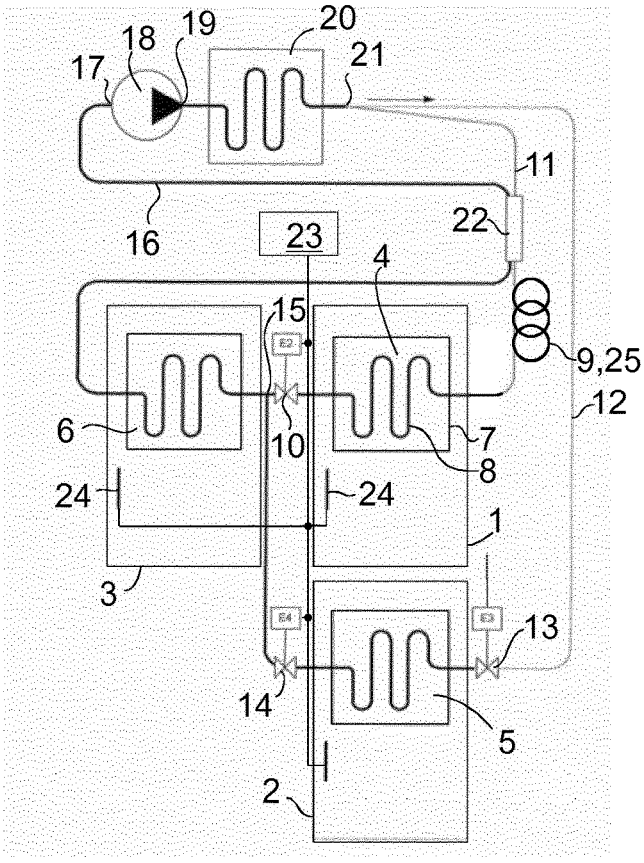
FIG. 2 shows a block diagram of a refrigeration appliance in accordance with a second embodiment.

According to an economical variant shown in FIG. 2, the choke point 9 is exclusively formed by a capillary tube 25, as described above, without an expansion valve. Although the choke point 9 cannot then be set, the pressure in the evaporator 4 can indeed continue to be set at will by adjusting the flow conductance value of the choke point 10. In this case, an adjustment of the choke point 10 does influence the overall refrigerant throughput of the two branches 11, 12, yet this may be compensated by an adaptation of the rotational speed of the compressor 18 and the flow conductance values of the choke points 13, 14.

According to other embodiments of the invention, the refrigerant circuit of a refrigeration appliance may also have more than the two parallel branches 11, 12 shown in FIG. 1. In principle, one such additional parallel branch could also comprise two evaporators linked in series and first meet the suction line once more downstream of the evaporator 6. In such a case, however, either pressure and temperature in the evaporator of the additional branch located downstream would be the same as in the evaporator 6, or a choke point would be necessary at the output of the two branches, which also brings about an inexpediently low temperature in the suction line 16 if it induces a pressure drop. For this reason, it is preferred for each branch, independently of the number of branches, to only comprise one evaporator and their junction 15 to always be connected upstream of another common evaporator 6 of a storage chamber 4 which can be used as a freezer compartment.

REFERENCE CHARACTERS

1 Storage chamber
2 Storage chamber
3 Storage chamber
4 Evaporator
5 Evaporator
6 Evaporator
7 Sheet
8 Refrigerant line
9 Choke point
10 Choke point
11 First branch
12 Second branch
13 Choke point
14 Choke point
15 Junction
16 Suction line
17 Suction port
18 Compressor
19 Pressure port
20 Condenser
21 Branching
22 Suction pipe heat exchanger
23 Control unit
24 Temperature sensor
25 Capillary tube

The invention claimed is:

1. A refrigeration appliance, comprising:

a compressor having a pressure port and a suction port;

a refrigerant circuit having a condenser, a first choke point, a first evaporator and a second choke point connected in series one after another between said pressure port and said suction port of said compressor;

said first evaporator being disposed for cooling a first storage chamber of the refrigeration appliance, and at least one of said first or second choke points being adjustable for controlling a pressure in said first evaporator;

said refrigerant circuit having a first branch and a second branch connected in parallel to said first branch;

a suction pipe heat exchanger arranged in said first branch between said pressure port and said first evaporator;

said first branch containing said first choke point, said first evaporator and said second choke point; and said second branch containing a series circuit of a third choke point, a second evaporator and a fourth choke point, said second branch bypassing said suction pipe heat exchanger for allowing compressed refrigerant in said second branch to reach said second evaporator without previously being cooled in a suction pipe heat exchanger;

said second evaporator being disposed in thermal contact with a second storage chamber of the refrigeration appliance, and at least one of said third or fourth choke points being adjustable for controlling a pressure in said second evaporator.

2. The refrigeration appliance according to claim 1, wherein both of said first and second choke points are adjustable.

3. The refrigeration appliance according to claim 1, wherein both of said third and fourth choke points are adjustable.

4. The refrigeration appliance according to claim 1, wherein at least one of said first or third choke points comprises a capillary tube.

5. The refrigeration appliance according to claim 1, wherein said compressor is a variable-speed compressor.

6. The refrigeration appliance according to claim 1, wherein a respective choke point is disposed between a most downstream said evaporator of any of said first and second branches and a junction, at which said first and second branches convene.

7. The refrigeration appliance according to claim 1, which further comprises a third evaporator for cooling a third storage chamber connected between said second choke point and said suction port of said compressor.

8. The refrigeration appliance according to claim 7, wherein said third evaporator is connected between said fourth choke point and said suction port of said compressor.

9. The refrigeration appliance according to claim 1 being a domestic refrigeration appliance.

* * * * *